US012188377B2

(12) United States Patent
Fukushima et al.

(10) Patent No.: US 12,188,377 B2
(45) Date of Patent: Jan. 7, 2025

(54) STEAM TURBINE

(71) Applicant: MITSUBISHI HEAVY INDUSTRIES, LTD, Tokyo (JP)

(72) Inventors: Hisataka Fukushima, Tokyo (JP); EI Kadokura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/603,682

(22) Filed: Mar. 13, 2024

(65) Prior Publication Data

US 2024/0337196 A1 Oct. 10, 2024

(30) Foreign Application Priority Data

Apr. 10, 2023 (JP) ..... 2023-063311

(51) Int. Cl.
*F01D 9/04* (2006.01)
*F01D 5/14* (2006.01)
*F01D 5/22* (2006.01)

(52) U.S. Cl.
CPC ..... *F01D 9/041* (2013.01); *F01D 5/141* (2013.01); *F01D 5/225* (2013.01)

(58) Field of Classification Search
CPC ..... F01D 5/225
See application file for complete search history.

(56) References Cited

U.S. PATENT DOCUMENTS

| | | | | |
|---|---|---|---|---|
| 9,062,551 | B2 * | 6/2015 | Simonet | F01D 11/02 |
| 10,494,927 | B2 * | 12/2019 | Haller | F01D 5/145 |
| 2015/0132114 | A1 * | 5/2015 | Fukushima | F01D 11/08 415/168.1 |
| 2023/0017440 | A1 | 1/2023 | Omura et al. | |

FOREIGN PATENT DOCUMENTS

| | | | | |
|---|---|---|---|---|
| GB | 2615366 | A * | 8/2023 | F01D 11/02 |
| JP | 58-178802 | | 10/1983 | |
| JP | 9-242502 | | 9/1997 | |
| JP | 2017-122406 | | 7/2017 | |
| JP | 6808872 | | 1/2021 | |

* cited by examiner

*Primary Examiner* — Courtney D Heinle
*Assistant Examiner* — Danielle M. Christensen
(74) *Attorney, Agent, or Firm* — Wenderoth, Lind & Ponack, L.L.P.

(57) ABSTRACT

A steam turbine according to at least one embodiment of the present disclosure, includes: a first rotor blade disposed in an outer periphery of a rotor; and a stator vane adjacent to the first rotor blade on a downstream side in an axial direction of the rotor. The stator vane has a stator vane airfoil portion, a tip-side wall surface located on a tip side of the stator vane airfoil portion, and a hub-side wall surface located on a hub side of the stator vane airfoil portion. The tip-side wall surface is inclined to approach a central axis of the rotor toward the downstream side in the axial direction.

4 Claims, 3 Drawing Sheets

STEAM TURBINE

TECHNICAL FIELD

The present disclosure relates to a steam turbine.

BACKGROUND

A steam turbine used for a power plant, etc. includes a rotor blade supported by a turbine rotor (hereinafter, simply referred to as a rotor) rotatable with respect to a casing and a stator vane supported by the casing, and is configured to convert energy of steam flowing from upstream to downstream in an axis direction of the rotor into rotational energy of the rotor.

In such steam turbine, a seal fin is provided to suppress leakage steam flow (tip leakage) between an outer shroud of the rotor blade and a stationary member facing this outer shroud in the radial direction (see, for example, Patent Document 1).

CITATION LIST

Patent Literature

Patent Document 1: JP6808872B

SUMMARY

As a result of intensive studies by the present inventors, it was found that when the tip leakage rejoins a main flow through the outer shroud of the rotor blade, a mixing loss occurs, as well as an additional loss also occurs due to interference with a secondary flow on an outer peripheral side of the stator vane.

In view of the above, an object of at least one embodiment of the present disclosure is to suppress the loss when the tip leakage rejoins the main flow of steam.

A steam turbine according to at least one embodiment of the present disclosure, includes: a first rotor blade disposed in an outer periphery of a rotor; and a stator vane adjacent to the first rotor blade on a downstream side in an axial direction of the rotor. The stator vane has a stator vane airfoil portion, a tip-side wall surface located on a tip side of the stator vane airfoil portion, and a hub-side wall surface located on a hub side of the stator vane airfoil portion. The tip-side wall surface is inclined to approach a central axis of the rotor toward the downstream side in the axial direction.

According to at least one embodiment of the present disclosure, it is possible to suppress a loss when tip leakage rejoins a main flow of steam.

DETAILED DESCRIPTION

Figure 1:
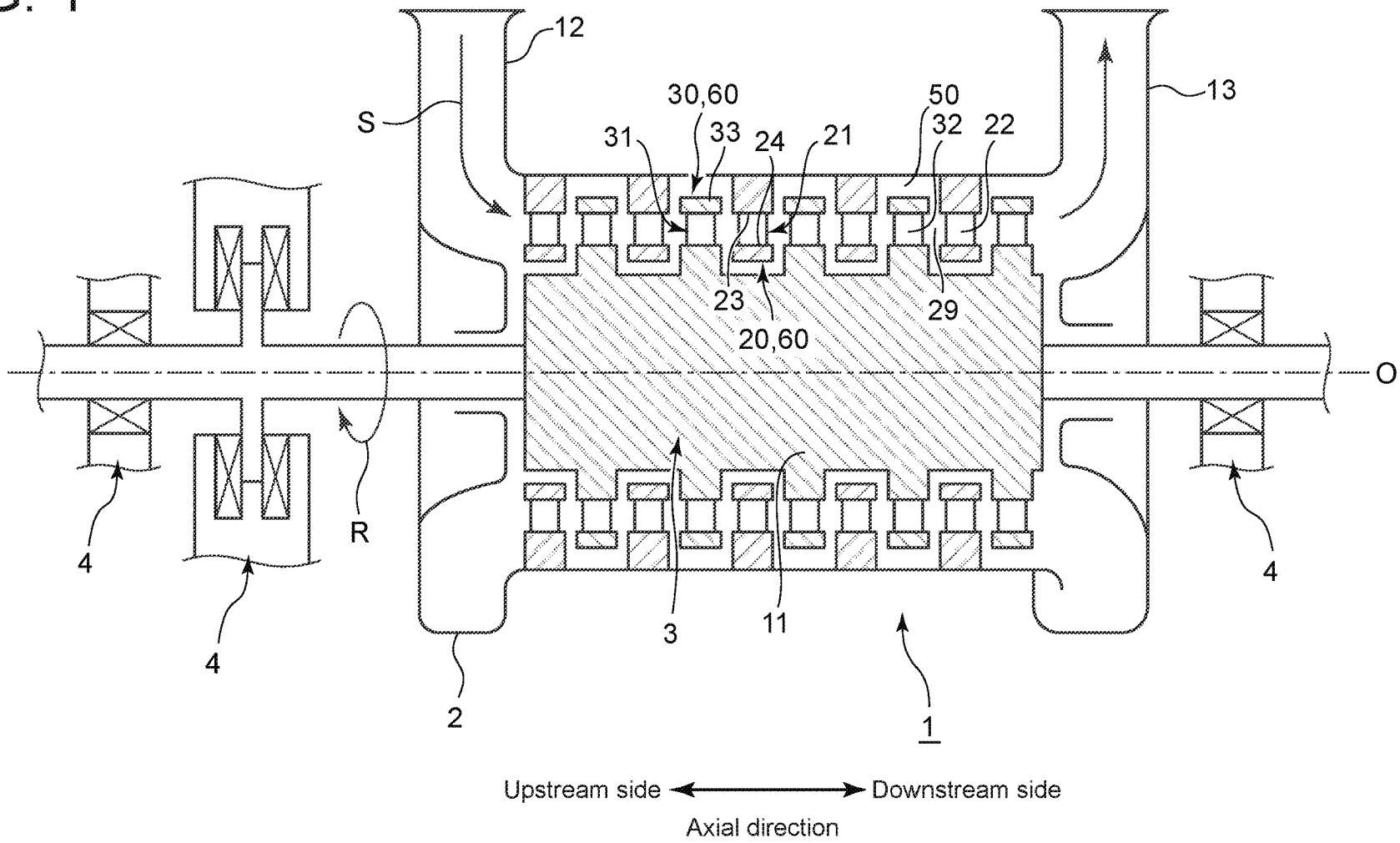
FIG. 1 is a view for describing a steam turbine according to some embodiments.

Some embodiments of the present disclosure will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

Figure 2:
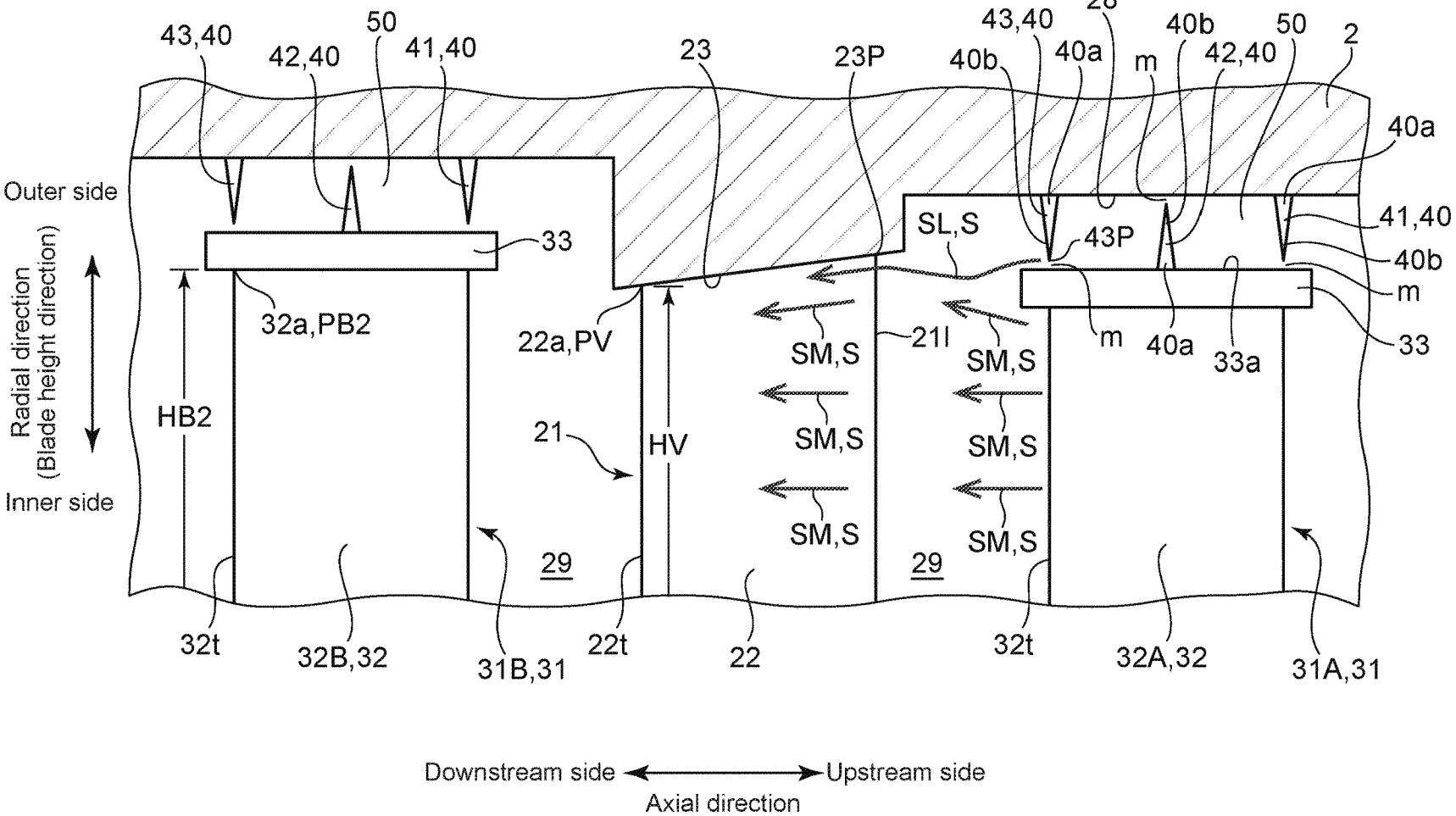
FIG. 2 is a view schematically showing the vicinity of radially outer end portions of airfoil portions of rotor blades and a stator vane according to an embodiment.
Figure 3:
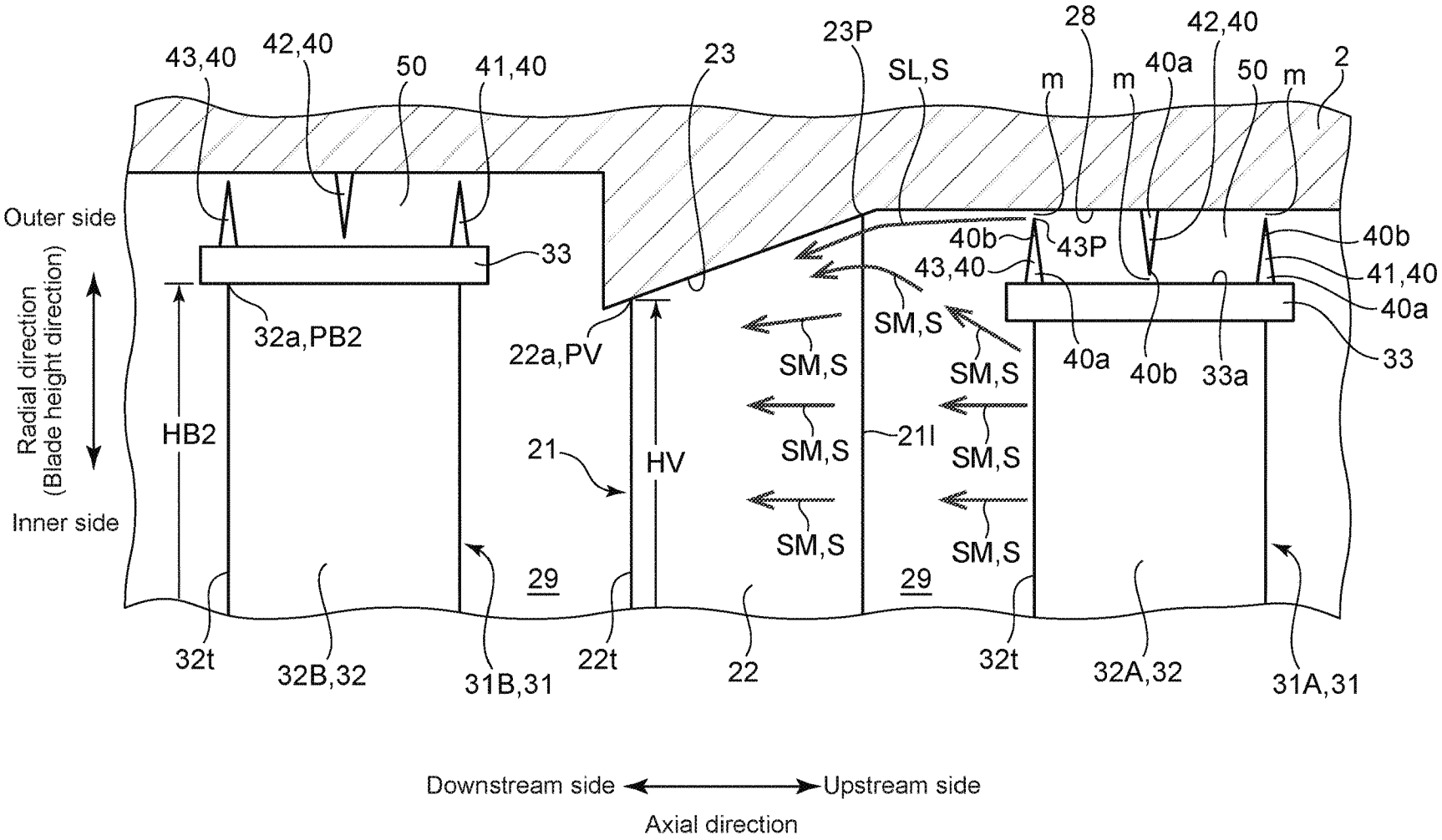
FIG. 3 is a view schematically showing the vicinity of the radially outer end portions of the airfoil portions of the rotor blades and the stator vane according to another embodiment.

FIG. 1 is a view for describing a steam turbine according to some embodiments. FIG. 2 is a view schematically showing the vicinity of radially outer end portions of airfoil portions of rotor blades and a stator vane according to an embodiment. FIG. 3 is a view schematically showing the vicinity of the radially outer end portions of the airfoil portions of the rotor blades and the stator vane according to another embodiment.

As shown in FIG. 1, a steam turbine 1 includes a rotor body 11 for rotating about an axis O, a rotor 3 connected to the rotor body 11, a steam supply pipe 12 for supplying steam S as a working fluid from a steam supply source (not shown) to the steam turbine 1, and a steam discharge pipe 13 connected to a downstream side of the steam turbine 1 and configured to discharge steam.

In FIG. 1, a side where the steam supply pipe 12 is located is referred to as an upstream side, and a side where the steam discharge pipe 13 is located is referred to as a downstream side. The following description will be given according to this.

As shown in FIG. 1, the steam turbine 1 includes the rotor 3 extending along an axis O direction (axial direction), a casing 2 which is a nearly cylindrical member disposed so as to cover the rotor 3 from the outer peripheral side, and bearing parts 4 rotatably supporting the rotor body 11 around the axis O.

In the following description, the axis O direction is also simply referred to as the axial direction, the radial direction centered on the axis O is also simply referred to as the radial direction, and the circumferential direction centered on the axis O is also simply referred to as the circumferential direction.

The steam turbine 1 according to some embodiments includes, inside the casing 2, a plurality of turbine stages 60 each of which is composed of a stator vane cascade 20 and a rotor blade cascade 30 adjacent to the stator vane cascade 20 on the downstream side of the stator vane cascade 20. The stator vane cascades 20 and the rotor blade cascades 30 are alternately disposed along the axial direction. Each of the stator vane cascades 20 is composed of a plurality of stator vanes 21 disposed around the rotor 3, and the plurality of stator vanes 21 are mounted on a casing 2 side. Each of the rotor blade cascades 30 is composed of a plurality of rotor blades 31 disposed around the rotor body 11, and the plurality of rotor blades 31 are mounted on the rotor body 11. That is, the rotor 3 includes the rotor body 11 and the rotor blade cascades 30.

The stator vanes 21 each have a stator vane airfoil portion 22, a tip-side wall surface 23 located on a tip side of the stator vane airfoil portion 22, i.e., the radially outer side, and a hub-side wall surface 24 located on a hub side of the stator vane airfoil portion 22, i.e., the radially inner side.

The rotor blades 31 each have a rotor blade airfoil portion 32 and an outer shroud 33 located on a tip side of the rotor blade airfoil portion 32, i.e., the radially outer side.

For the descriptive convenience, the rotor blade 31 adjacent to the stator vane 21, which is illustrated in FIGS. 2 and 3, on the upstream side in the axial direction, i.e., the rotor blade 31 of the turbine stage on the immediately upstream side of the turbine stage to which the stator vane 21 illustrated in FIGS. 2 and 3 belongs is designated as a first rotor blade 31A. In the following description, the rotor blade airfoil portion 32 of the first rotor blade 31A is also referred to as a first rotor blade airfoil portion 32A.

For the descriptive convenience, the rotor blade 31 adjacent to the stator vane 21, which is illustrated in FIGS. 2 and 3, on the downstream side in the axial direction, i.e., the rotor blade 31 of the turbine stage to which the stator vane 21 illustrated in FIGS. 2 and 3 belongs is designated as a second rotor blade 31B. In the following description, the rotor blade airfoil portion 32 of the second rotor blade 31B is also referred to as a second rotor blade airfoil portion 32B.

Inside the casing 2, a region where the stator vane cascades 20 and the rotor blade cascades 30 are arranged forms a main flow passage 29 where the steam S as the working fluid flows.

Further, spaces are formed between the outer shrouds 33 and an inner peripheral surface 28 of the casing 2, and the spaces are referred to as cavities 50.

As shown in FIGS. 2 and 3, the cavities 50 according to some embodiments are provided with seal fins (seal structures) 40. The seal fins 40 of some embodiments are annular members extending radially inward from the inner peripheral surface 28 of the casing 2, or annular members formed on outer surfaces 33*a* of the outer shrouds 33 and extending to the radially outer side from the outer surfaces 33*a* of the outer shrouds 33 toward the inner peripheral surface 28 of the casing 2. More specifically, each of the seal fins 40 is formed to have a shape with a thickness in the axis O direction gradually decreasing from a base end portion 40*a* toward a tip end portion 40*b*.

In some embodiments shown in FIGS. 2 and 3, three rows of the seal fins 40 are arranged inside each of the cavities 50 along the axis O direction, and the seal fins 40 are referred to as a first seal fin 41, a second seal fin 42, and a third seal fin 43 in this order from the upstream side.

That is, the seal fins 40 are disposed in multiple rows at intervals in the axial direction and between the outer shroud 33 and the casing 2 which is a stationary member located on a radially outer side with respect to the outer shroud 33.

The number of seal fins 40 arranged inside the cavity 50 along the axis O direction is not limited to the three rows, but can be not less than one row.

In the embodiment shown in FIG. 2, the first seal fins 41 and the third seal fins 43 extend radially inward from the inner peripheral surface 28 of the casing 2, and the second seal fins 42 extend to the radially outer side from the outer surfaces 33*a* of the outer shrouds 33 toward the inner peripheral surface 28 of the casing 2.

In the embodiment shown in FIG. 3, the first seal fins 41 and the third seal fins 43 extend to the radially outer side from the outer surfaces 33*a* of the outer shrouds 33 toward the inner peripheral surface 28 of the casing 2, and the second seal fins 42 extend radially inward from the inner peripheral surface 28 of the casing 2.

As shown in FIGS. 2 and 3, in some embodiments, the radially inner or outer tip end portions 40*b* of the seal fins 40 form minute gaps m with the outer surfaces 33*a* of the outer shrouds 33 facing the tip end portions 40*b* or with the inner peripheral surface 28 of the casing 2. Considering a thermal expansion amount of the casing 2 or the rotor blade airfoil portions 32, a centrifugal expansion amount of the rotor blade airfoil portions 32, etc., a dimension of the gaps m in the radial direction is decided in a range where the tip end portions 40*b* of the seal fins 40 do not contact members of the counterparts facing the tip end portions 40*b*.

In the steam turbine 1 thus configured according to some embodiments, the steam S from the steam supply source is supplied to the steam turbine 1 via the steam supply pipe 12.

The steam S supplied to the steam turbine 1 reaches the main flow passage 29. The steam S reaching the main flow passage 29 flows toward the downstream side while repeatedly expanding and turning a flow as the steam S flows through the main flow passage 29. Since the rotor blade airfoil portions 32 each have an airfoil cross-section, the steam S hits the rotor blade airfoil portions 32 or a reaction force in expansion of the steam is also received inside an inter-blade flow passage formed between the rotor blade airfoil portions 32 adjacent along the circumferential direction, thereby rotating the rotor 3. Consequently, energy of the steam S is extracted as rotational power of the steam turbine 1.

The steam S flowing through the main flow passage 29 in the above-described process also flows into the aforementioned cavities 50. That is, the steam S flowing into the main flow passage 29 is divided into main steam flows SM and a leakage steam flow SL (tip leakage) after passing through the stator vane cascade 20. The main steam flows SM are introduced into the rotor blade cascade 30 without any leakage.

The leakage steam flow SL flows into the cavity 50 via between the outer shroud 33 and the casing 2.

The leakage steam flow SL flowing into the cavity 50 successively passes through the gaps m formed by the first seal fin 41, the second seal fin 42, and the third seal fin 43. The leakage steam flow SL passing through the gap m formed by the third seal fin 43 flows into the stator vane cascade 20 of the next stage together with the main steam flows SM passing through the rotor blade cascade 30.

As a result of intensive studies by the present inventors, it was found that when the leakage steam flow SL rejoins the main steam flows SM passing through the rotor blade cascade 30, a mixing loss occurs, as well as an additional loss also occurs due to interference with a secondary flow on an outer peripheral side of the stator vane in the stator vane cascade 20 of the next stage.

Therefore, in the steam turbine 1 according to some embodiments, in order to suppress the above-described mixing loss, the tip-side wall surface 23 is inclined to approach the axis O of the rotor 3 toward the downstream side in the axial direction as shown in FIGS. 2 and 3.

Whereby, the leakage steam flow SL passing through the outer shroud 33 of the first rotor blade 31A can smoothly rejoin the main steam flows SM, making it possible to reduce the mixing loss when the leakage steam flow SL rejoins the main steam flows SM, as well as to suppress the interference with the secondary flow on the outer peripheral side of the stator vane 21.

In the steam turbine 1 according to some embodiments, a position 43P in the radial direction of the tip end portion 40*b* of the third seal fin 43 which is the seal fin 40 located on the most downstream side among the multiple rows of the seal fins 40 is the same as a position 23P in the radial direction of the tip-side wall surface 23 at a leading edge end 211 of the stator vane 21 or is located radially inward of the position 23P.

Whereby, a flow of the leakage steam flow SL flowing out of the tip end portion 40*b* of the third seal fin 43 which is the seal fin 40 located on the most downstream side flows relatively smoothly to the stator vane 21. Therefore, it is possible to further suppress the mixing loss due to the interference between the leakage steam flow SL and the secondary flow on the outer peripheral side of the stator vane when the leakage steam flow SL rejoins the main steam flows SM.

The position of the tip end portion 40*b* of the third seal fin 43 which is the seal fin 40 located on the most downstream side among the multiple rows of the seal fins 40 is a position where the stationary member and a rotating member face each other in the radial direction, and is a position defining radial and axial outflow start positions of the leakage steam flow SL toward the rotor blade cascade 30 on the downstream side.

In the steam turbine 1 according to some embodiments, as shown in FIG. 2, the third seal fin 43 which is the seal fin 40 located on the most downstream side preferably projects toward the outer shroud 33 from the inner peripheral surface 28 of the casing 2 serving as the stationary member.

Whereby, the radial outflow position of the leakage steam flow SL flowing out of the tip end portion 40*b* of the third seal fin 43 is relatively located on the radially inner side. Therefore, it is possible to relatively decrease an inclination angle of the tip-side wall surface 23 inclined to approach the axis O of the rotor 3 toward the downstream side in the axial direction, making it possible to suppress an influence of the inclination angle of the tip-side wall surface 23 on the flows of the steam S flowing along the stator vane 21.

In the steam turbine 1 according to some embodiments, as shown in FIG. 3, the third seal fin 43 which is the seal fin 40 located on the most downstream side may project from the outer shroud 33 toward the inner peripheral surface 28 of the casing 2 serving as the stationary member.

Whereby, even if the third seal fin 43 projects from the outer shroud 33 toward the stationary member (the inner peripheral surface 28 of the casing 2), it is possible to suppress the mixing loss due to the interference between the leakage steam flow SL and the secondary flow on the outer peripheral side of the stator vane when the leakage steam flow SL rejoins the main steam flows SM.

In the steam turbine 1 according to some embodiments, a blade height HB2 of the second rotor blade airfoil portion 32B at a trailing edge end 32*t* of the second rotor blade 31B is preferably the same as a vane height HV of the stator vane airfoil portion 22 at a trailing edge end 22*t* of the stator vane 21 or higher than the vane height HV.

Alternatively, a position PB2 in the radial direction of a radially outer end portion 32*a* of the second rotor blade airfoil portion 32B of the second rotor blade 31B at the trailing edge end 32*t* of the second rotor blade 31B is preferably the same as a position PV in the radial direction of a radially outer end portion 22*a* of the stator vane airfoil portion 22 at the trailing edge end 22*t* of the stator vane 21 or located on a radially outer side relative to the position PV in the radial direction.

Whereby, the vane height HV of the stator vane 21 and the blade height HB2 of the second rotor blade 31B are suitable for the flows of the steam (main steam flows SM) whose volume expands toward the downstream side in the steam turbine 1.

The present disclosure is not limited to the above-described embodiments, and also includes an embodiment obtained by modifying the above-described embodiments or an embodiment obtained by combining these embodiments as appropriate.

The contents described in the above embodiments would be understood as follows, for instance.

(1) A steam turbine 1 according to at least one embodiment of the present disclosure, includes: a first rotor blade 31A disposed in an outer periphery of a rotor 3 (rotor body 11); and a stator vane 21 adjacent to the first rotor blade 31A on a downstream side in an axial direction of the rotor 3. The stator vane 21 has a stator vane airfoil portion 22, a tip-side wall surface 23 located on a tip side of the stator vane airfoil portion 22, and a hub-side wall surface 24 located on a hub side of the stator vane airfoil portion 22. The tip-side wall surface 23 is inclined to approach a central axis (axis O) of the rotor 3 toward the downstream side in the axial direction.

According to the above configuration (1), since the tip-side wall surface 23 is inclined to approach the central axis (axis O) of the rotor 3 toward the downstream side in the axial direction, the tip leakage (leakage steam flow SL) passing through the outer shroud 33 of the first rotor blade 31A can smoothly rejoin the main flows of the steam (main steam flows SM), making it possible to reduce the mixing loss when the tip leakage (leakage steam flow SL) rejoins the main flows of the steam (main steam flows SM), as well as to suppress the interference with the secondary flow on the outer peripheral side of the stator vane 21.

(2) In some embodiments, in the above configuration (1), the first rotor blade 31A has an outer shroud 33 disposed on a radially outer side of the rotor 3 with respect to the first rotor blade airfoil portion 32A of the first rotor blade 31A. The steam turbine 1 according to at least one embodiment includes seal fins 40 of an arc shape which are disposed in multiple rows at intervals in the axial direction of the rotor 3 and between the outer shroud 33 and a stationary member (casing 2) located on the radially outer side with respect to the outer shroud 33, and extend in a circumferential direction of the rotor 3. A position in a radial direction of the rotor 3 of a tip (tip end portion 40*b*) of the seal fin 40 (third seal fin 43) located on a most downstream side in the axial direction among the multiple rows of the seal fins 40 is preferably the same as a position in the radial direction of the tip-side wall surface 23 at a leading edge end 211 of the stator vane 21 or located inward in the radial direction relative to the position.

According to the above configuration (2), the flow of the tip leakage (leakage steam flow SL) flowing out of the tip (tip end portion 40*b*) of the seal fin 40 (third seal fin 43) located on the most downstream side in the axial direction flows relatively smoothly to the stator vane 21. Whereby, it is possible to further suppress the mixing loss due to the interference between the tip leakage (leakage steam flow SL) and the secondary flow on the outer peripheral side of the stator vane 21 when the tip leakage (leakage steam flow SL) rejoins the main flows of the steam (main steam flows SM).

(3) In some embodiments, in the above configuration (2), the seal fin 40 (third seal fin 43) located on the most downstream side in the axial direction preferably projects from the stationary member (the inner peripheral surface 28 of the casing 2) toward the outer shroud 33.

According to the above configuration (3), the outflow position in the radial direction of the tip leakage (leakage steam flow SL) flowing out of the tip (tip end portion 40*b*) of the seal fin 40 (third seal fin 43) located on the most downstream side in the axial direction is located relatively radially inward. Whereby, it is possible to relatively decrease an inclination angle of the tip-side wall surface 23 inclined to approach the central axis (axis O) of the rotor 3 toward the downstream side in the axial direction. Whereby, it is possible to suppress an influence of the inclination angle of the tip-side wall surface 23 on the flows of the steam (main steam flows SM) flowing along the stator vane 21.

(4) In some embodiments, in the above configuration (2), the seal fin 40 (third seal fin 43) located on the most downstream side in the axial direction may project from the outer shroud 33 toward the stationary member (the inner peripheral surface 28 of the casing 2).

According to the above configuration (4), even if the seal fin 40 (third seal fin 43) projects from the outer shroud 33 toward the stationary member (the inner peripheral surface 28 of the casing 2), it is possible to suppress the mixing loss due to the interference between the tip leakage (leakage steam flow SL) and the secondary flow on the outer peripheral side of the stator vane 21 when the tip leakage (leakage steam flow SL) rejoins the main flows of the steam (main steam flows SM).

(5) In some embodiments, in any of the above configurations (1) to (4), the steam turbine 1 may include a second rotor blade 31B disposed in the outer periphery of the rotor 3 (rotor body 11) and on the downstream side in the axial direction of the stator vane 21. A blade height HB2 of a second rotor blade airfoil portion 32B of the second rotor blade 31B at a trailing edge end 32*t* of the second rotor blade 31B is preferably the same as a vane height HV of the stator vane airfoil portion 22 at a trailing edge end 22*t* of the stator vane 21 or higher than the vane height HV.

According to the above configuration (5), the vane height HV of the stator vane 21 and the blade height HB2 of the second rotor blade 31B are suitable for the flows of the steam (main steam flows SM) whose volume expands toward the downstream side in the steam turbine 1D.

The invention claimed is:

1. A steam turbine, comprising:

a first rotor blade disposed in an outer periphery of a rotor; and a stator vane adjacent to the first rotor blade on a downstream side in an axial direction of the rotor, wherein the stator vane has a stator vane airfoil portion, a tip-side wall surface located on a tip side of the stator vane airfoil portion, and a hub-side wall surface located on a hub side of the stator vane airfoil portion, and wherein the tip-side wall surface is inclined to approach a central axis of the rotor toward the downstream side in the axial direction, wherein the first rotor blade has an outer shroud disposed on a radially outer side of the rotor with respect to the first rotor blade airfoil portion of the first rotor blade, wherein the steam turbine comprises seal fins of an arc shape which are disposed in multiple rows at intervals in the axial direction of the rotor and between the outer shroud and a stationary member located on the radially outer side with respect to the outer shroud, and extend in a circumferential direction of the rotor, and wherein a position in a radial direction of the rotor of a tip of the seal fin located on a most downstream side in the axial direction among the multiple rows of the seal fins is the same as a position in the radial direction of the tip-side wall surface at a leading edge end of the stator vane or located inward in the radial direction relative to the position.

2. The steam turbine according to claim 1, wherein the seal fin located on the most downstream side in the axial direction projects from the stationary member toward the outer shroud.

3. The steam turbine according to claim 1, wherein the seal fin located on the most downstream side in the axial direction projects from the outer shroud toward the stationary member.

4. The steam turbine according to claim 1, comprising:

a second rotor blade disposed in the outer periphery of the rotor and on the downstream side in the axial direction of the stator vane, wherein a blade height of a second rotor blade airfoil portion of the second rotor blade at a trailing edge end of the second rotor blade is the same as a vane height of the stator vane airfoil portion at a trailing edge end of the stator vane or higher than the vane height.

* * * * *